US006839445B2

(12) United States Patent
Kihara

(10) Patent No.: US 6,839,445 B2
(45) Date of Patent: Jan. 4, 2005

(54) PIEZOELECTRIC SPEAKER

(75) Inventor: Takaei Kihara, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 329 days.

(21) Appl. No.: 10/125,453

(22) Filed: Apr. 19, 2002

(65) Prior Publication Data

US 2002/0186856 A1 Dec. 12, 2002

(30) Foreign Application Priority Data

Jun. 7, 2001 (JP) ..... 2001-172788

(51) Int. Cl.[7] ..... H04R 25/00

(52) U.S. Cl. ..... 381/190; 381/398; 381/430; 181/171; 181/173

(58) Field of Search ..... 381/190, 398, 381/430, 114, 173, 191; 181/171, 173, 155, 153; 310/34, 322, 324, 335; 367/180, 155

(56) References Cited

U.S. PATENT DOCUMENTS 6,563,930 B1 * 5/2003 Nakamura et al. ..... 381/190

* cited by examiner

*Primary Examiner*—Curtis Kuntz
*Assistant Examiner*—Tuan Duc Nguyen
(74) *Attorney, Agent, or Firm*—Keating & Bennett, LLP

(57) ABSTRACT

A piezoelectric speaker includes a piezoelectric vibrator and a metal reflection plate. The piezoelectric vibrator includes a piezoelectric element which has a dome shape with a hollow portion and which is polarized in the thickness direction, a first electrode disposed on the inner surface of the piezoelectric element, a second electrode disposed on the outer surface of the piezoelectric element. The piezoelectric vibrator further includes a hole provided in the top thereof. The reflection plate is arranged to cover the hollow portion of the piezoelectric vibrator.

20 Claims, 2 Drawing Sheets

PIEZOELECTRIC SPEAKER

BACKGROUND OF THE INVENTION

1. Field of the Invention

The present invention generally relates to piezoelectric speakers, and more specifically, to a piezoelectric speaker using a piezoelectric element and having an improved sound pressure characteristic, preferably for use as a tweeter.

2. Description of the Related Art

FIG. 4 is a sectional view of a piezoelectric speaker of the related art.

Referring to FIG. 4, a piezoelectric speaker 40 has a piezoelectric vibrator 1. The piezoelectric vibrator 1 includes a piezoelectric element 2 which has a dome shape with a hollow portion and which has a uniform thickness, a first electrode 3 disposed on the inner surface of the piezoelectric element 2, and a second electrode 4 disposed on the outer surface of the piezoelectric element 2. The dome-shaped piezoelectric element 2 is polarized in the thickness direction.

In the piezoelectric speaker 40 constructed in this manner, when an external signal source 5 applies a signal between the first electrode 3 and the second electrode 4, the entire surface of the piezoelectric element 2 expands and contracts correspondingly. The expansion and contraction thereof causes a "breathing vibration" of the entire dome-shaped piezoelectric element 2, thereby generating sound.

In the piezoelectric speaker 40 of the related art, however, sounds 6*a* and 6*b* which are generated from the inner surface of the dome-shaped piezoelectric vibrator 1 are transmitted inwardly, that is, toward the opposite side, and thus do not contribute to the level of sound emitted from the piezoelectric speaker 40. Consequently, only sound pressure provided by a sound 8 generated from the outer surface is available, and hence the piezoelectric speaker 40 requires an increase in the level of sound pressure.

FIG. 3 shows the sound pressure vs. frequency characteristic of the piezoelectric speaker 40 of the related art, in which a dome-shaped piezoelectric vibrator having a diameter of 20 mm is used. The vertical axis indicates the sound pressure level (S.P.L.) and the horizontal axis indicates the frequency. FIG. 3 also shows the sound pressure characteristic of a piezoelectric speaker 10 of preferred embodiments of the present invention, and the details thereof will be described later. The sound pressure characteristic of the piezoelectric filter 40 of the related art is indicated by a dotted line and the sound pressure characteristic of the piezoelectric speaker 10 of preferred embodiments of the present invention is indicated by a solid line.

The piezoelectric speaker 40 has a effective frequency range of about 15 kHz to about 100 kHz. The piezoelectric vibrator 1 has a natural oscillation frequency of about 103 kHz, which is higher than the effective frequency range of the dome-shaped piezoelectric vibrator 1.

FIG. 3 shows the sound pressure characteristic in the frequency band of 20 kHz to 50 kHz which is particularly important in the effective frequency range.

In FIG. 3, the average sound pressure level in the frequency band of 20 kHz to 50 kHz is not necessarily sufficient. In some cases, it is desired that the sound pressure level for an entire effective frequency range or for a certain frequency band be further increased.

SUMMARY OF THE INVENTION

In order to overcome the problems described above, preferred embodiments of the present invention provide a piezoelectric speaker that achieves a significant increase in the sound pressure level.

According to a preferred embodiment of the present invention, a piezoelectric speaker includes a piezoelectric vibrator and a reflection plate. The piezoelectric vibrator includes a piezoelectric element which has a dome shape with a hollow portion and which is polarized in the thickness direction, a first electrode disposed on the inner surface of the piezoelectric element, a second electrode disposed on the outer surface of the piezoelectric element, and a hole. A reflection plate is preferably provided opposite to the hollow portion of the piezoelectric vibrator.

With this arrangement, the piezoelectric speaker of the present invention effectively increases the sound pressure level.

Preferably, the hole is provided in the vicinity of the top of the piezoelectric vibrator.

With the piezoelectric speaker of preferred embodiments of the present invention, when a signal is applied externally between the first electrode and the second electrode, not only sound generated from the outer surface of the piezoelectric vibrator, but also sound generated from the inner surface thereof can also be obtained as sound in such a manner that the sounds generated from the inner surface are reflected by the reflection plate and pass through the hole in the top of the piezoelectric vibrator. As a result, the sound pressure level in the effective frequency range is greatly increased.

The piezoelectric vibrator may have a natural frequency that is higher than a effective frequency range, and the hole provided in the piezoelectric vibrator preferably causes a reduction in the natural frequency of the piezoelectric vibrator.

This arrangement makes it possible to reduce the natural frequency of the piezoelectric vibrator and to generate a derivative frequency to be located in the effective frequency range, thereby allowing an improvement in the sound pressure level in a certain effective frequency range.

Other features, elements, characteristics and advantages of the present invention will become more apparent from the following detailed description of preferred embodiments with reference to the drawings thereof.

DETAILED DESCRIPTION OF PREFERRED EMBODIMENTS

Figure 1:
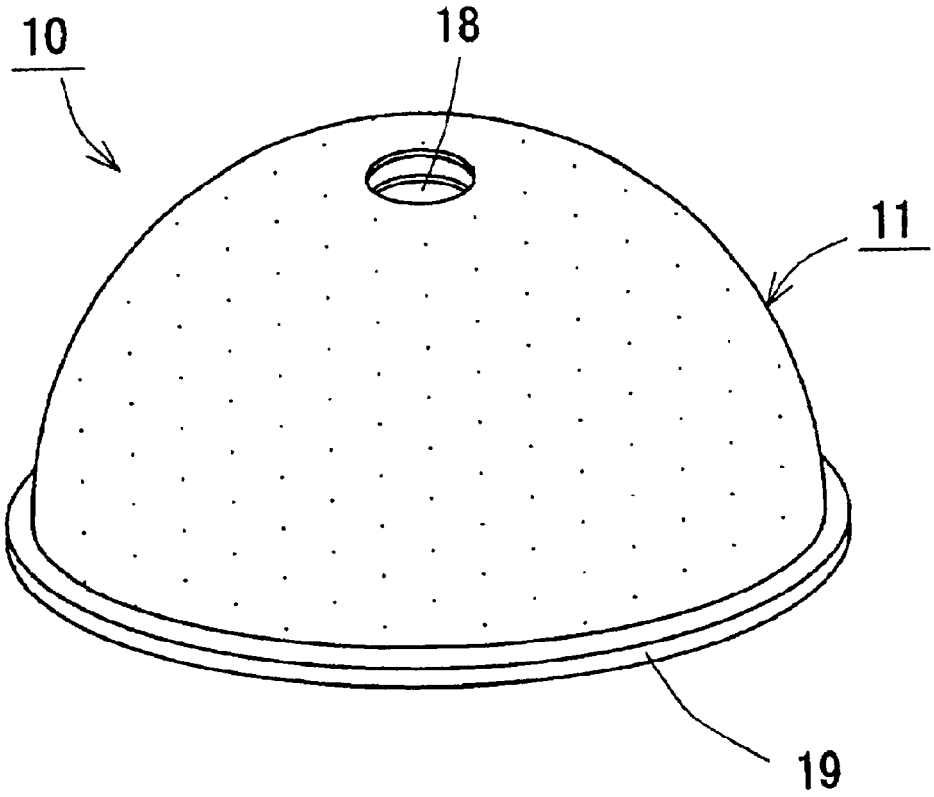
FIG. 1 is a perspective view of a piezoelectric speaker according to a preferred embodiment of the present invention.
Figure 2:
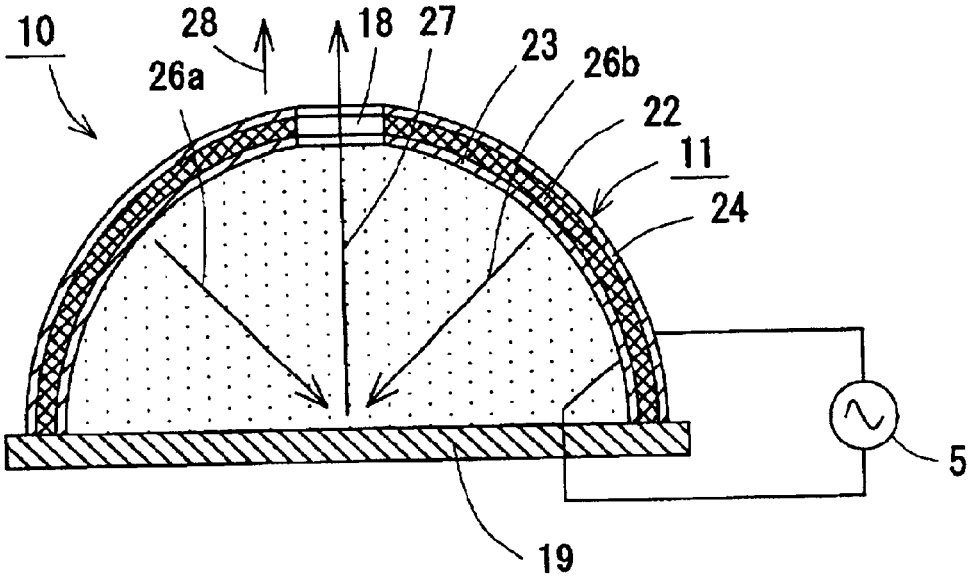
FIG. 2 is a sectional view of the piezoelectric speaker according to the preferred embodiment of FIG. 1.

FIGS. 1 and 2 are a perspective view and a sectional view, respectively, of a piezoelectric speaker according to a preferred embodiment of the present invention.

Referring to FIGS. 1 and 2, a piezoelectric speaker 10 of a preferred embodiment of the present invention includes a piezoelectric vibrator 11 and a reflection plate 19 preferably made of metal. The piezoelectric vibrator 11 includes a piezoelectric element 22 which has a dome shape with a hollow portion and which has a substantially uniform thickness, a first electrode 23 disposed on the inner surface of the piezoelectric element 22, and a second electrode 24 disposed on the outer surface of the piezoelectric element 22. The dome-shaped piezoelectric vibrator 11 has a substantially round hole 18 in the top thereof. The piezoelectric element 22 is polarized in the thickness direction. The reflection plate 19 is arranged so as to cover substantially the entire hollow portion of the dome-shaped piezoelectric vibrator 11.

It is to be noted that, when the hollow portion of the dome-shaped piezoelectric vibrator 11 is directed downward, the term "top" herein refers to the area that is located at the uppermost portion of the dome-shaped piezoelectric vibrator 11.

In the piezoelectric speaker 10 constructed in this manner, when an external signal source 5 applies a signal between the first electrode 23 and the second electrode 24, opposing portions of the first electrode 23 and the second electrode 24 of the piezoelectric element 22 expand and contract correspondingly. This causes a "breathing vibration" of the entire dome-shaped piezoelectric element 22, thereby generating sound.

In the piezoelectric speaker 10 of a preferred embodiment of the present invention, not only a sound 28 generated from the outer surface of the dome-shaped piezoelectric vibrator 11, but sounds 26*a* and 26*b* generated from the inner surface thereof can also be obtained as a sound 27 in such a manner that the sounds 26*a* and 26*b* are reflected by the metal reflection plate 19 and pass through the hole 18 located in the top of the dome-shaped piezoelectric vibrator 11. As a result, the sound pressure level in the effective frequency range is greatly increased.

In addition, a hole provided in a piezoelectric vibrator having a natural frequency higher than a effective frequency range of about 15 kHz to about 100 kHz effectively reduces the natural frequency of the piezoelectric vibrator. In the present preferred embodiment, when a hole having a diameter of, for example, about 3 mm is provided in the top of a dome-shaped piezoelectric vibrator which has a natural frequency of about 103 kHz and which has a diameter of, for example, about 20 mm, the natural frequency of the piezoelectric speaker is reduced to about 80 kHz. In this case, a derivative frequency of about 40 kHz is generated, so that the sound pressure level in the effective frequency range is improved at the frequency of about 80 kHz and about 40 kHz.

Figure 3:
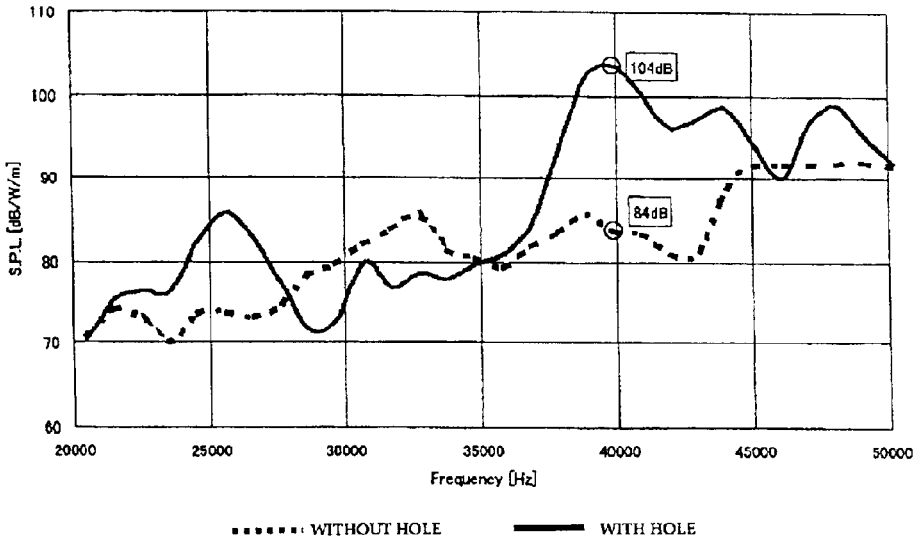
FIG. 3 is a graph showing the sound pressure vs. frequency characteristics of the piezoelectric speaker of a preferred embodiment of the present invention and a piezoelectric speaker of the related art.
Figure 4:
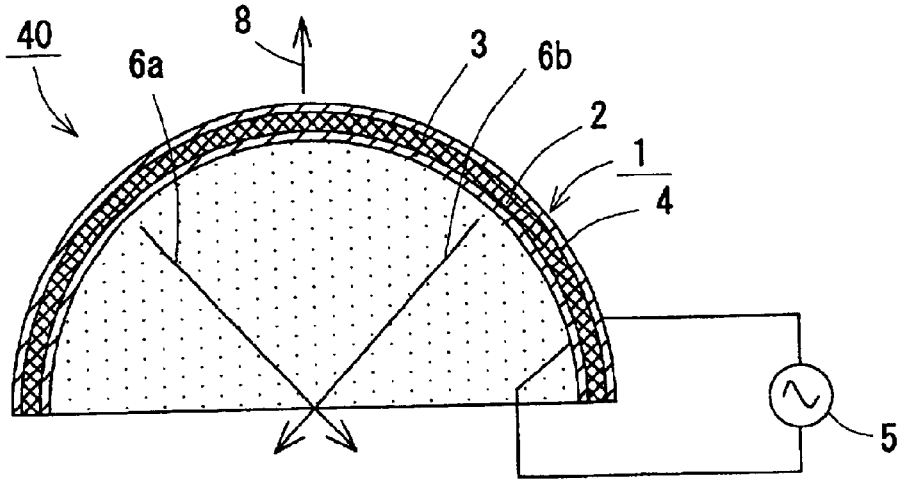
FIG.4 PRIOR ART
FIG. 4 is a sectional view of the piezoelectric speaker of the related art.

FIG. 3 shows the sound pressure vs. frequency characteristic of the piezoelectric speaker 10 of a preferred embodiment of the present invention.

As previously described in the "Background of the Invention", FIG. 3 also shows the sound pressure characteristic of the piezoelectric speaker 40 of the related art, and the sound pressure characteristic of the piezoelectric speaker 10 of a preferred embodiment of the present invention is indicated by a solid line and the sound pressure characteristic of the piezoelectric filter 40 of the related art is indicated by a dotted line. FIG. 3 shows the sound pressure characteristic in the frequency band of 20 kHz to 50 kHz which is particularly critical in the effective frequency range.

As can be seen from FIG. 3, at the frequency of 40 kHz, the piezoelectric speaker 10 of a preferred embodiment of the present invention exhibits a significant increase in the sound pressure level from 84 dB of the piezoelectric speaker 40 of the related art to about 104 dB. The average sound pressure level in the frequency band of 20 kHz to 50 kHz is increased by about 4 dB.

The term "dome" used herein represents a round-roof-like shape, including a hemisphere or partial sphere, which generally has a substantially elliptic arc or a substantially circular arc shaped vertical-section and which generally has a substantially elliptic or a substantially circular shaped horizontal-section. The curvature thereof may also vary partially. Further, the thickness thereof does not necessarily have to be uniform.

While the sound pressure vs. frequency characteristic shown in FIG. 3 represents a case in which a hole having a diameter of about 3 mm is provided in the top of a dome-shaped piezoelectric vibrator having a diameter of about 20 mm, that structure is merely an example of preferred embodiments of the present invention. Thus, the size of the dome-shaped piezoelectric vibrator, the size of the hole, the number of holes, the position of the hole or holes, and the shape of the hole or holes are not limited to what has been described in preferred embodiments of the present invention.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A piezoelectric speaker comprising:

a piezoelectric vibrator including a piezoelectric element which has a dome shape with a hollow portion, a first electrode disposed on the inner surface of the piezoelectric element, a second electrode disposed on the outer surface of the piezoelectric element, and a hole formed in the piezoelectric vibrator; and a reflection plate disposed to cover the hollow portion of the piezoelectric vibrator; wherein the piezoelectric vibrator generates sound in response to a signal being applied between the first electrode and the second electrode.

2. A piezoelectric speaker according to claim 1, wherein the hole is provided in the top of the piezoelectric vibrator.

3. A piezoelectric speaker according to claim 1, wherein the piezoelectric vibrator has a natural frequency that is higher than an effective frequency range, and the hole provided in the piezoelectric vibrator causes a reduction in the natural frequency of the piezoelectric vibrator.

4. A piezoelectric speaker according to claim 1, wherein the hole is substantially round.

5. A piezoelectric speaker according to claim 1, wherein the reflection plate is made of metal.

6. A piezoelectric speaker according to claim 1, wherein the piezoelectric element has a substantially uniform thickness.

7. A piezoelectric speaker according to claim 1, wherein sounds generated from the inner surface of the piezoelectric vibrator are reflected by the reflection plate and pass through the hole in the piezoelectric vibrator.

8. A piezoelectric speaker according to claim 1, wherein the hole has a diameter of about 3 mm.

9. A piezoelectric speaker according to claim 1, wherein the piezoelectric vibrator has a diameter of about 20 mm.

10. A piezoelectric speaker according to claim 1, wherein the piezoelectric vibrator is polarized in the thickness direction thereof.

11. A piezoelectric speaker comprising:

a piezoelectric vibrator including a piezoelectric element which has a dome shape with a hollow portion, a first electrode disposed on the inner surface of the piezoelectric element, a second electrode disposed on the outer surface of the piezoelectric element, and a hole formed in the piezoelectric vibrator; and a reflection plate disposed opposite to the hollow portion of the piezoelectric vibrator; wherein sounds generated from the inner surface of the piezoelectric vibrator are reflected by the reflection plate and pass through the hole in the piezoelectric vibrator.

12. A piezoelectric speaker according to claim 11, wherein the hole is provided in the top of the piezoelectric vibrator.

13. A piezoelectric speaker according to claim 11, wherein the piezoelectric vibrator has a natural frequency that is higher than an effective frequency range, and the hole provided in the piezoelectric vibrator causes a reduction in the natural frequency of the piezoelectric vibrator.

14. A piezoelectric speaker according to claim 11, wherein the hole is substantially round.

15. A piezoelectric speaker according to claim 11, wherein the reflection plate is made of metal.

16. A piezoelectric speaker according to claim 11, wherein the piezoelectric element has a substantially uniform thickness.

17. A piezoelectric speaker according to claim 11, wherein the piezoelectric vibrator generates sound in response to a signal being applied between the first electrode and the second electrode.

18. A piezoelectric speaker according to claim 11, wherein the hole has a diameter of about 3 mm.

19. A piezoelectric speaker according to claim 11, wherein the piezoelectric vibrator has a diameter of about 20 mm.

20. A piezoelectric speaker according to claim 11, wherein the piezoelectric vibrator is polarized in the thickness direction thereof.

* * * * *